US005142127A

United States Patent [19]

Abellana et al.

[11] Patent Number: 5,142,127

[45] Date of Patent: Aug. 25, 1992

[54] TAPE FEED DEVICE FOR A POSTAGE METER MAILING MACHINE

[75] Inventors: Jovito N. Abellana, Trumbull; Danilo P. Buan, Easton; Thomas M. Lyga, Torrington, all of Conn.

[73] Assignee: Pitney Bowes Inc., Stamford, Conn.

[21] Appl. No.: 607,414

[22] Filed: Oct. 31, 1990

[51] Int. Cl.[5] ..... G07G 1/00; B41L 47/46

[52] U.S. Cl. ..... 235/101; 101/91

[58] Field of Search ..... 235/101; 101/91, 228, 101/235

[56] References Cited

U.S. PATENT DOCUMENTS

| | | | |
|---|---|---|---|
| 4,922,085 | 5/1990 | Dannatt et al. | 235/101 |
| 4,957,179 | 9/1990 | Dannatt | 101/91 |
| 4,958,782 | 9/1990 | Dannatt et al. | 242/75.43 |

*Primary Examiner*—L. T. Hix
*Assistant Examiner*—Eddie C. Lee
*Attorney, Agent, or Firm*—Charles G. Parks, Jr.; David E. Pitchenik; Melvin J. Scolnick

[57] ABSTRACT

A mailing machine base includes a postage meter insertable and removable from a receptacle means, said receptacle means being mounted within said base and a tape feed assembly positioned between a home position and a second position. A tape frame assembly includes a first frame section including feed means for receiving a tape and causing said tape to displace in said tape track and gear means for driving said feed means, said tape track being fixably mounted to said first frame section at one end and aligned to receive tape from said feed means. A tape track being fixably mounted to said first frame section at one end and aligned to receive tape from said feed means; rail means fixably mounted in said base for displaceable supporting said tape frame therealong; said tape frame assembly having second section having support member means supported by and riding along said rail means for supporting said first frame section; first drive means for displacing said frame assembly between a home position and a print position; second drive means for driving said gear means; and, coupler means for coupling said second drive means to said gear means only when said tape frame assembly is in the home position.

3 Claims, 12 Drawing Sheets

FIG. II

FIG. IIA

TAPE FEED DEVICE FOR A POSTAGE METER MAILING MACHINE

RELATED APPLICATION

This patent application relates to a displaceable tape feed device for a postage meter mailing machine as described in U.S. Pat. No. 4,957,179 entitled TAPE MODULE FOR A MODULAR MAILING MACHINE and to U.S. patent application Ser. No. 291,462 filed Dec. 28, 1988 entitled LOCKING DEVICE FOR REMOVABLE POSTAGE METER.

BACKGROUND OF THE INVENTION

The present invention relates to a displaceable tape feed assembly for a postage meter mailing machine.

In one configuration of an electronic postage meter mailing machine of the flat-bed printing type, the mailing machine is comprised of a base vertically supporting a plurality of support walls. A receptacle including a meter locking assembly is pivotally supported between two of the support walls. The receptacle is intended to receive one end of a postage meter and then locate the meter in its working position. Also, mounted in the base is a tape feed mechanism. The tape feed mechanism is laterally positionable between a home position and a print or second position. When the tape unit is in the home position, tape is fed.

The postage meter is comprised of a housing, a printing device disposed in the housing, an aperture in the housing exposing the printing device to the exterior of the housing, a cover for the aperture, means mounting the cover to the postage meter for movement of the cover from a closed position in which the cover is disposed at the aperture denying access to the printing device, and an open position in which the cover is disposed away from the aperture. The cover is structured to prevent access to the printing device when the cover is in the closed position and to permit access to the printing device when the cover is in the open position, and the receptacle locking assembly includes first engaging means for engaging the cover in a predetermined position of the postage meter, and driving means located in the base acting through a gear assembly for driving the first engaging means to move the cover between the closed and open positions thereof.

The postage meter, tape mechanism and base assembly of the type described employs a minimum of three motors. It is the object of the present invention to present a tape mechanism which can be coupled and uncoupled to a drive source to allow the drive source to be employed in the performance of machine functions, for example, it drives the meter lock assembly.

SUMMARY OF THE INVENTION

It is an objective of the present invention to provide an improved tape feed assembly which is more economical. The base includes a tape track and aligned cam rod. A tape feed assembly is slidably mounted to and supported by the tape track and cam rod such that rotation of the tape track motor causes the tape assembly to be positionable from a home position to a spring position. The tape assembly includes a drive gear assembly which is only brought into engagement when the tape feed assembly is in the home position, the drive assembly being driven by a second motor. In the home position, the tape feed assembly upon initiation of second motor is caused to motivate tape into the tape feed assembly.

The drive gear assembly includes a hub gear which is mounted to shaft. The shaft has fixably mounted at its other end a spool which is in driving communication, such as by endless belts, with first engaging means. The hub gear is mounted such that when the tape feed assembly is in the second position, the hub gear is engaged to the second drive motor for displacing the meter engaging means. However, when the tape feed assembly is in the home position, the hub gear is disassociated from the drive gear assembly and the second motor is used to feed tape through the tape feed assembly.

DETAILED DESCRIPTION OF THE INVENTION

Figure 1:
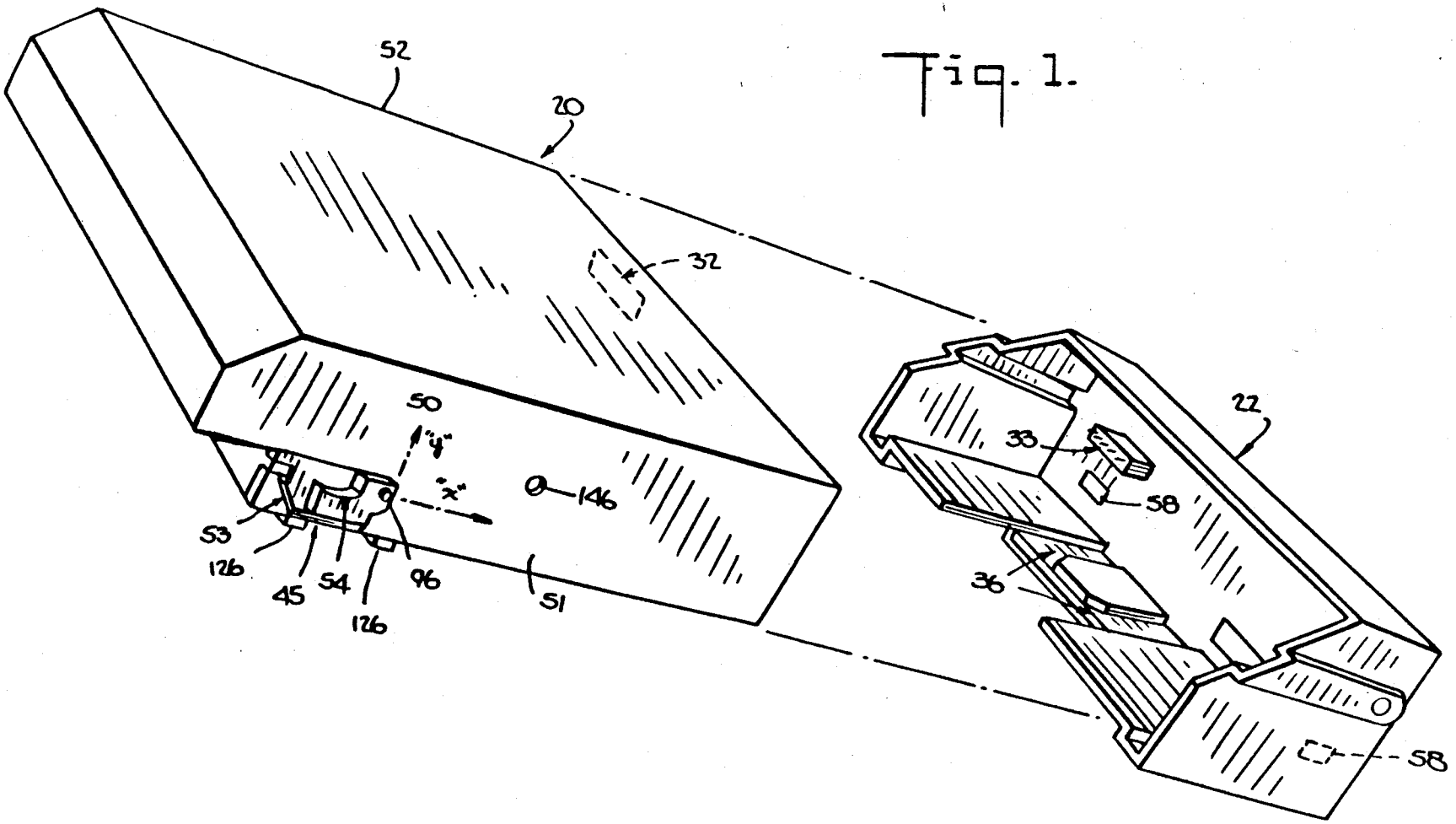
FIG. 1 is a top, exploded perspective view of a postage meter according to the invention and a meter pocket according to the invention into which the postage meter is seated for use in a mailing machine.
Figure 3:
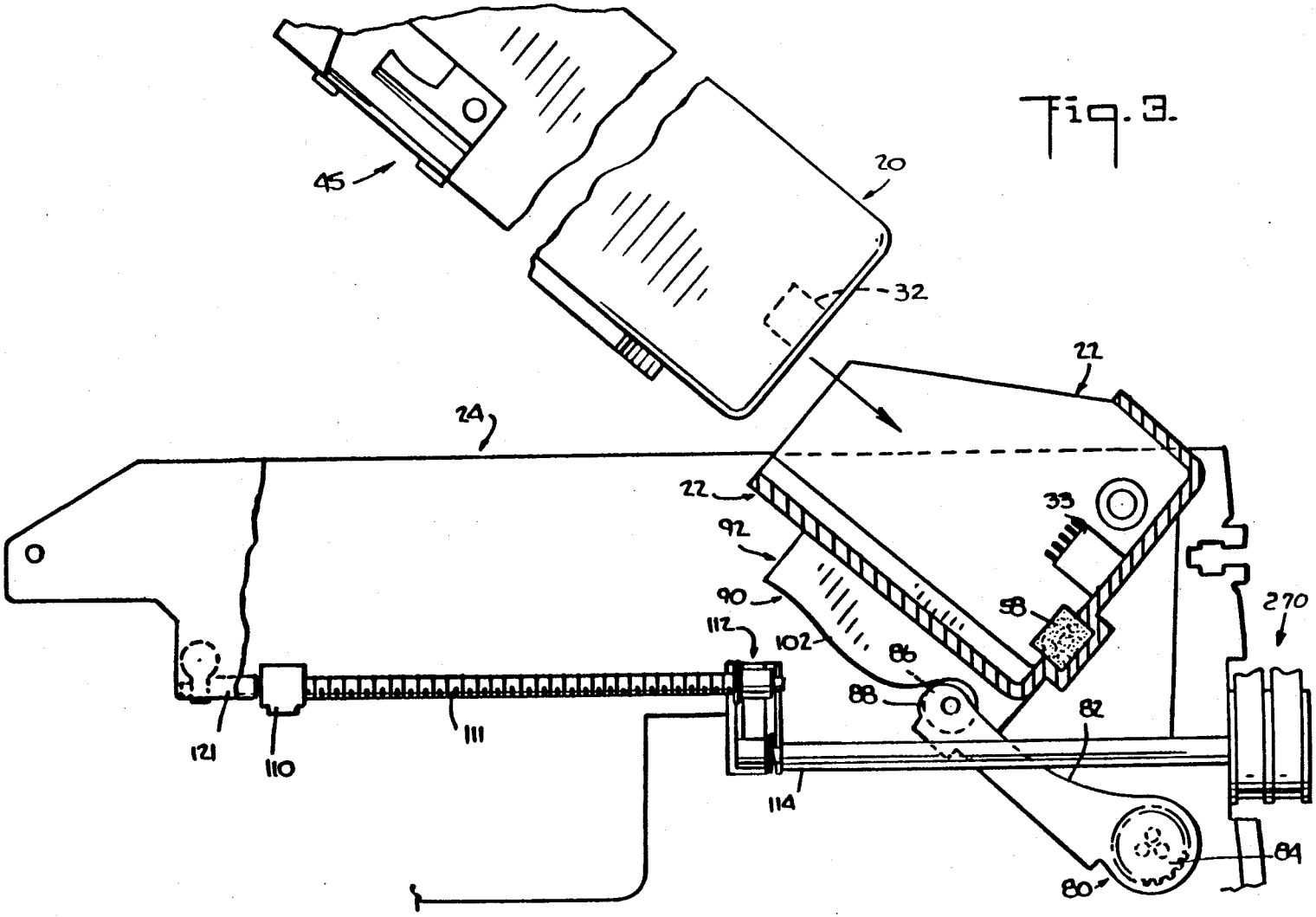
FIG. 3 is a side view, partially in section, of the postage meter and meter pocket depicted in FIG. 1 and a locking device according to the invention into which the postage meter and meter pocket are seated and locked, the postage meter and the meter pocket being shown exploded as in FIG. 1.
Figure 6:
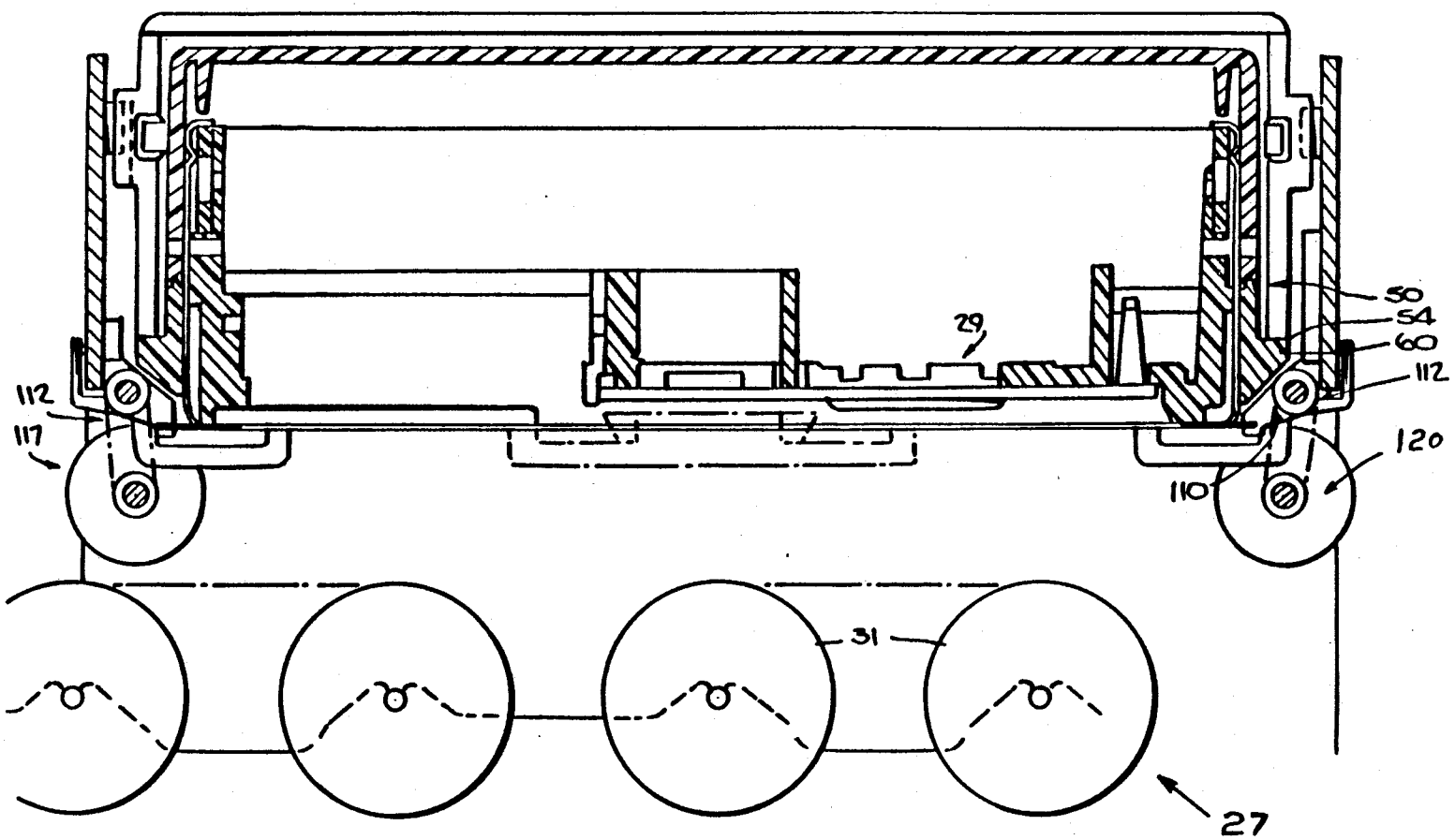
FIG. 6 is a section view taken transversely through the postage meter, locking device and mailing machine depicted in FIG. 5.

Referring to FIG. 1, postage meter 20 is insertable and removable from postage meter pocket 22, which in turn is pivotally mounted to postage meter locking device 24 (FIG. 3). The locking device 24 is pivotally mounted to a base 25. Postage meter 20 includes a printing device generally indicated as 29 for printing postage indicia and related indicia such as a town seal, slogans, advertising, etc., and circuitry and structure for setting printing device 29 to print desired indicia, entering authorized postage amounts, and for record keeping of various items such as postage dispensed, postage remaining, etc. Locking device 24 in the disclosed embodiment forms part of a mailing machine which may include a transport device 27 including transport rollers 31 (FIG. 6), an inking device (not shown) which imparts ink to a print die (FIG. 6) of printing device 29 in the postage meter, and a platen device (not shown) which tamps an ink pad of inking device (not shown) against the print die of printing device to ink it, and also tamps a mail piece or tape against the print die of printing device 29 to imprint postage and other indicia thereon. The mailing machine and various parts thereof are described in U.S. Pat. No. 4,935,078 entitled "High Throughput Mailing Machine Timing". Postage meter 20, meter pocket 22 and locking device 24 may also be constructed as a module to be utilized alone or as part of a larger machine.

Figure 2:
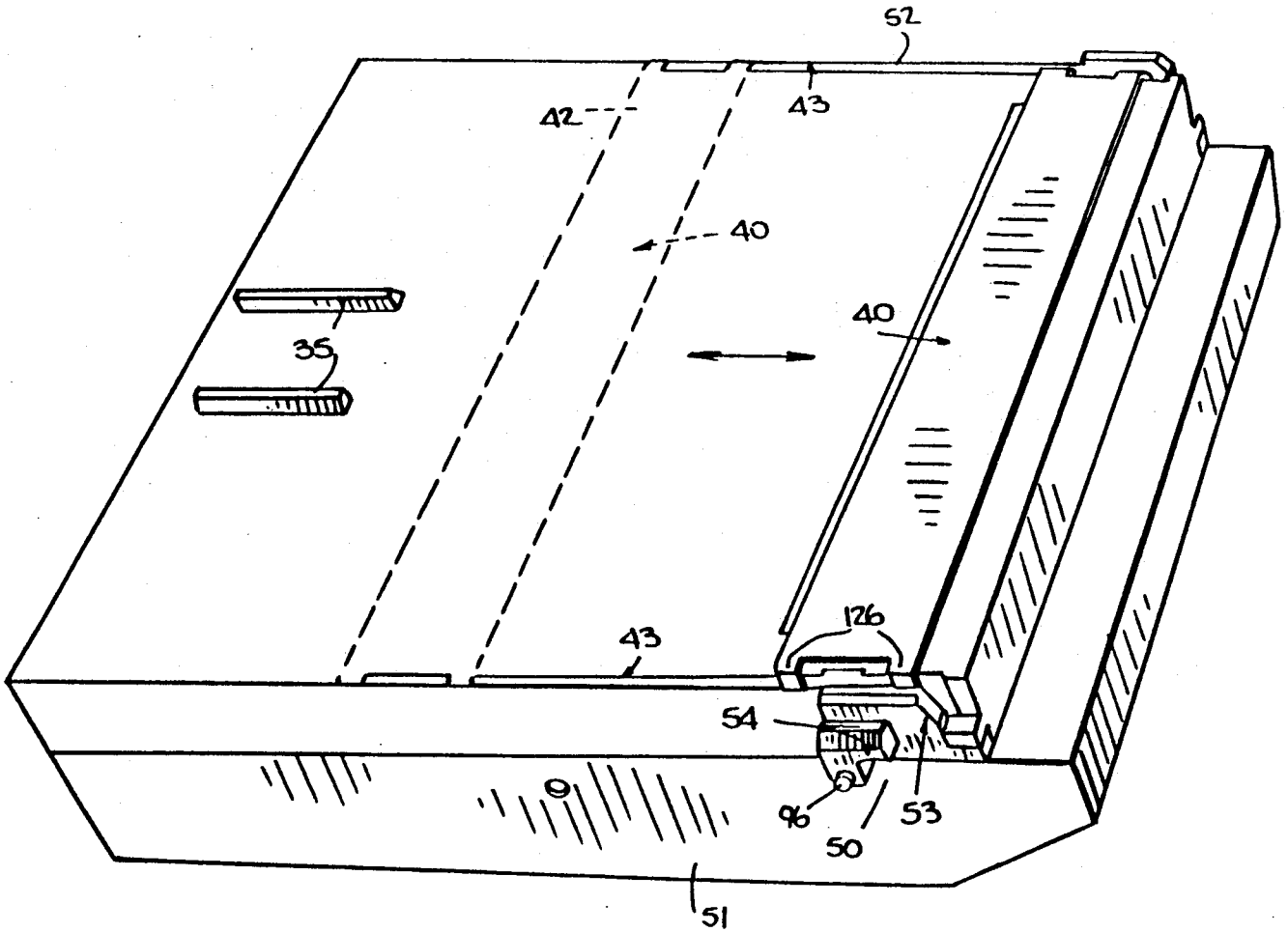
FIG. 2 is a bottom perspective view of the postage meter depicted in FIG. 1.

Postage meter 20 and meter pocket 22 include mating connectors 32, 33 by means of which signals are exchanged between postage meter 20, locking device 24, and, in the disclosed embodiment, among meter 20, locking device 24 and mailing machine. Connectors 32, 33 also supply power to postage meter 20. Referring to FIGS. 1 and 2, postage meter 20 and meter pocket 22 including mating dovetail structure 35, 36 for aligning postage meter 20 in meter pocket 22 so that connectors 32 and 33 electrically and mechanically engage when meter 20 is fully seated in pocket 22. Postage meter 20 may be unseated from meter pocket 22 (see FIG. 1) and removed for postage entry, inspection, servicing, etc., or for gaining access to parts of mailing machine 26 for servicing, ink cartridge replacement, etc.

Figure 4:
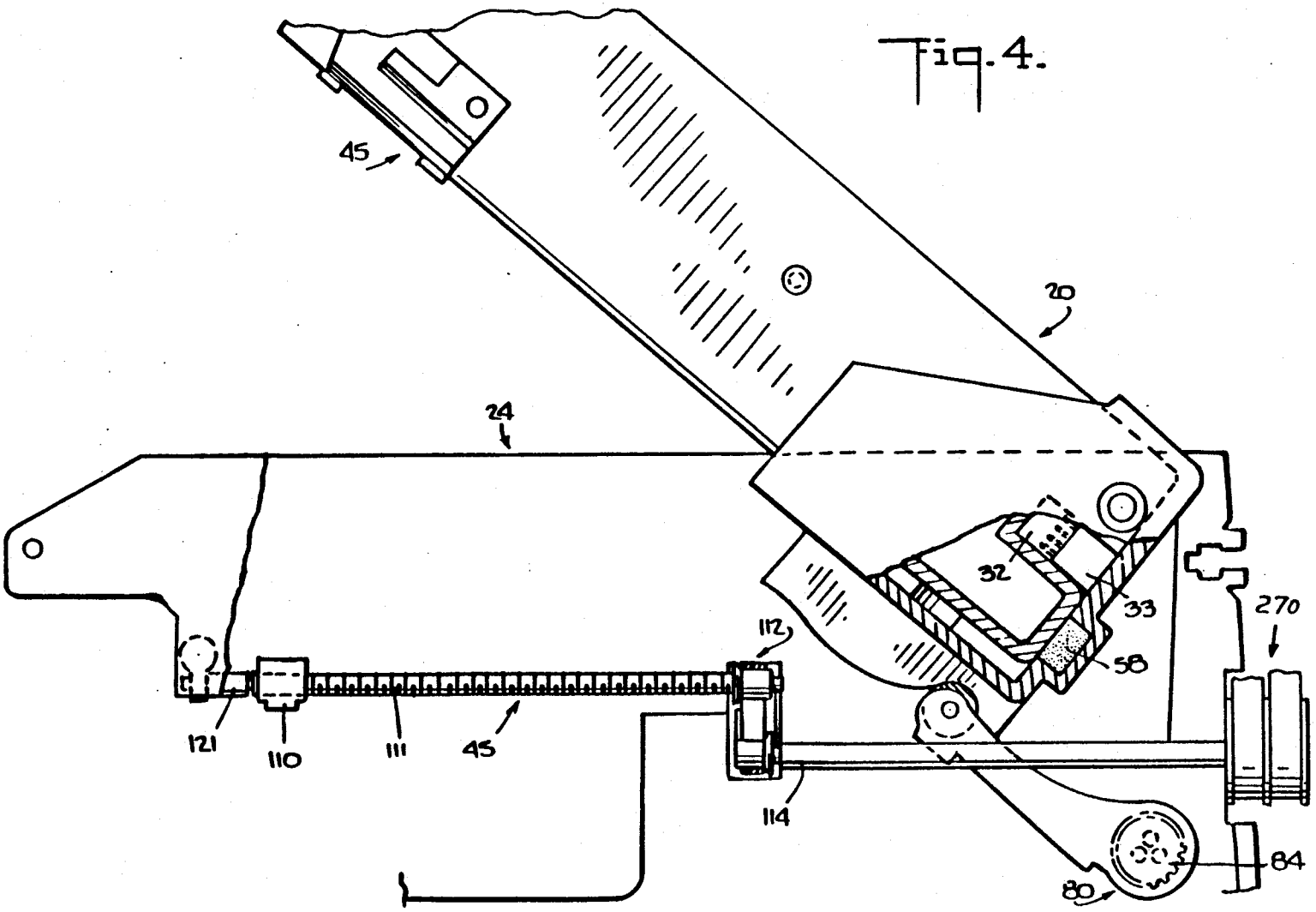
FIG. 4 is a view similar to that of FIG. 3 with the postage meter seated in the meter pocket.
Figure 5:
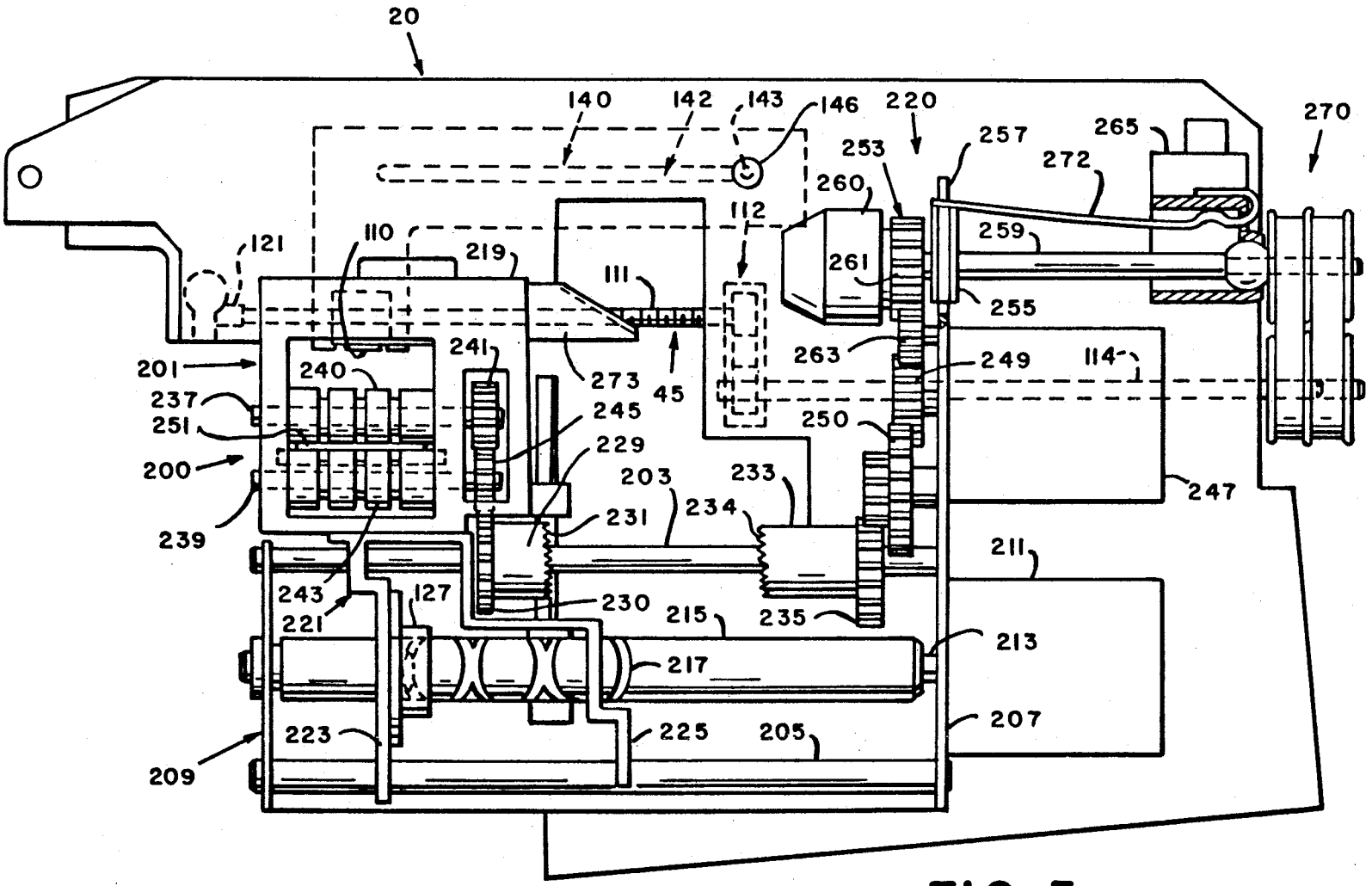
FIG. 5 is a side view, partially in section and partly broken away, of the postage meter, meter pocket and locking device depicted in FIGS. 3 and 4, with the postage meter and meter pocket seated and locked in the locking device in a wait position, this FIGURE also showing part of a mailing machine of which the postage meter forms part.

Referring to FIG. 2, postage meter 20 includes a shutter bar or cover 40 which in its closed position (FIG. 2) covers the print die of printing device 29 to protect same, to prevent unauthorized use of meter 20 and to inhibit tampering. Shutter bar 40 is movable to its open position, illustrated by broken lines in FIG. 2, at the ends 42 of shutter bar guide slots 43 to expose the print die of printing device 29. Referring to FIGS. 3–5, meter 20 is loaded and locked into end by locking device 24 by first seating meter 20 in pocket 22 (FIGS. 3 and 4), and the pivoting meter 20 seated in pocket 24 into locking device 24 (FIG. 5). Once meter 20 is locked into locking device 24, shutter bar 40 may be retracted to its open position (to the right in FIG. 5) by drive mechanism 45 ready to imprint postage indicia on mail pieces and/or tape.

Figure 7:
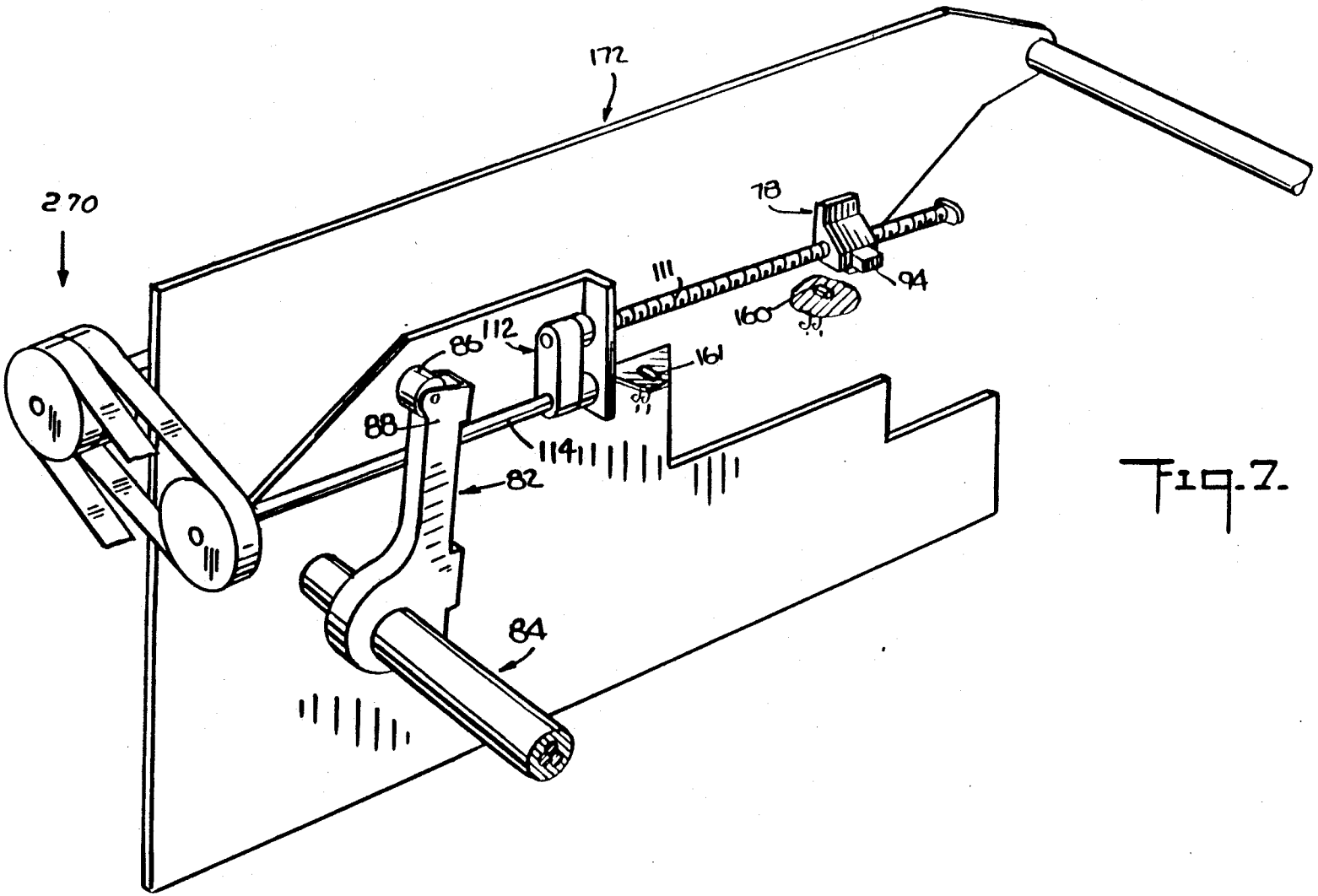
FIG. 7 is a perspective diagram showing part of a drive system of the locking device.

Referring to FIG. 3, meter pocket 22 is mounted to locking device 24 by a counterbalance mechanism 80 which includes counterbalance arm 82 fixed to torsion bar 84 (FIG. 7). Pivoting of arm 82 torsions the torsion bar 84 which resists pivoting and urges arm 84 back to its rest position depicted in FIG. 3. Roller 86 is rotatably mounted to end 88 of arm 82 to ride along cam surface 90 of counterbalance cam 92 attached to the bottom of meter pocket 22. Referring to the sequence of FIGS. 3–5, postage meter 20 is inserted into meter pocket 22, as illustrated by FIGS. 3 and 4, and meter 20 and pocket 22 are pivoted against the force of counterbalance torsion bar 84 to lower meter 20 into locking device 24 into the position depicted in FIG. 5. Postage meter 20 and meter pocket 22 are mechanically locked in locking device 24 by a latching arrangement (not here shown, but is fully described and disclosed in U.S. patent application Ser. No. 291,462 filed Dec. 28, 1988 incorporated herein by reference herein) urged upwardly by the action of torsion bar 84.

When postage meter 20 is removed from locking device 24 the counterbalance torsion bar 84 pivots counterbalance arm 82 clockwise. Clockwise pivoting of arm 82 causes counterbalance cam 92 to follow roller 86 and move meter 20 and pocket 22 to the right from the FIG. 5 position to the point 102 on camming surface 90. Cam surface 90 is configured so that meter 20 and pocket 22 rise under the action of torsion bar 84 about 1 inch when unlatched from the latching assembly from cam 54. This indicates to an operator that meter 20 is unlocked and may be removed by further pivoting the meter to the 45 degree position depicted in FIG. 2, and withdrawing it from meter pocket 22.

Referring to FIGS. 3–7, drive mechanism 45 for moving shutter bar 40 between its open and closed positions, comprises, on each side of locking device 24, a shutter bar carrier 110, lead screw 111, belt coupler 112, shaft 114, belt couplers, 117 and drive gear assembly 120. Bearing 121 supports lead screws 111. Shutter bar carriers 110 engage shutter bar 45 and upon rotation of lead screws 111 move shutter bar 45. Shutter bar carriers 110 include a prong or projection 94 (FIG. 7) which is received between prongs 126 (FIGS. 1 and 2) of shutter bar 40 for engaging shutter bar 40 to move it. Shutter bar carriers 110 are threaded to lead screws 111 which are rotated by the drive gear assembly 120 to advance shutter bar carriers 110 along lead screws 111. The drive gear assembly 120 is coupled by belt couplers 117 to drive shafts 114 on each side of locking device 24. Each drive shaft 114 is in turn coupled to a lead screw 111 by another belt coupler 112. Belt couplers 112 are used to couple lead screws 111 and shafts 114, rather than having lead screw 111 run the full distance to belt couplers 117 in order to reduce the overall length of lead screws 111. Rotation of the drive gear assembly 120 causes the lead screws 111 on both sides of locking device 24 to rotate in synchronism and thereby advance shutter bar carriers 110 on each side of the locking device 24. As depicted in FIG. 5, shutter bar carriers 110 are moved to the right from the broken-line wait position, through the solid line position, the broken line open position.

Figure 8:
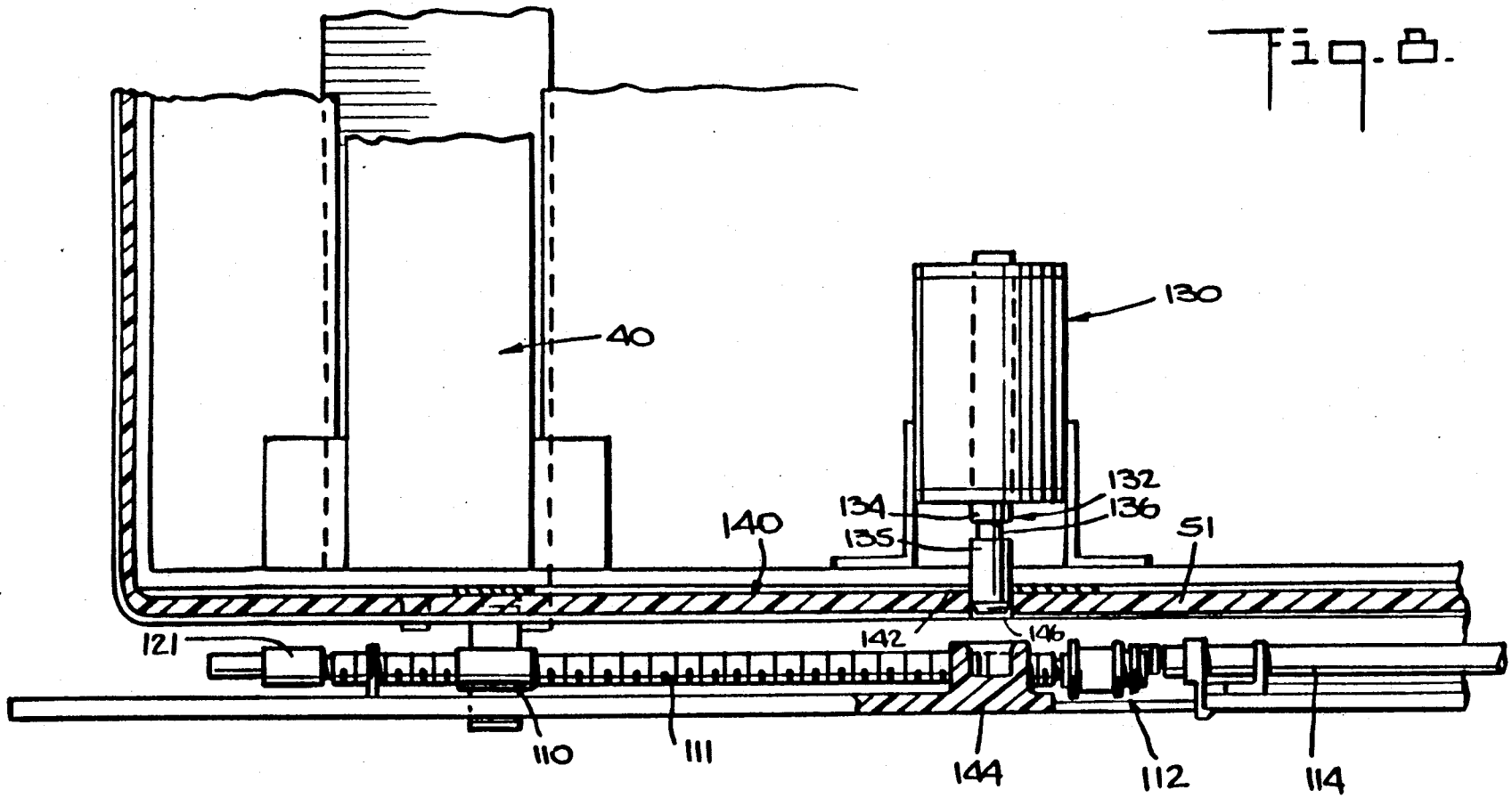
FIG. 8 is a longitudinal section view of a part of the postage meter and locking mechanism showing a locking solenoid disposed in the postage meter engaging a movable cover or shutter of the postage meter in a locking position, and a shutter carrier of a drive for moving the shutter shown in a wait position.
Figure 9:
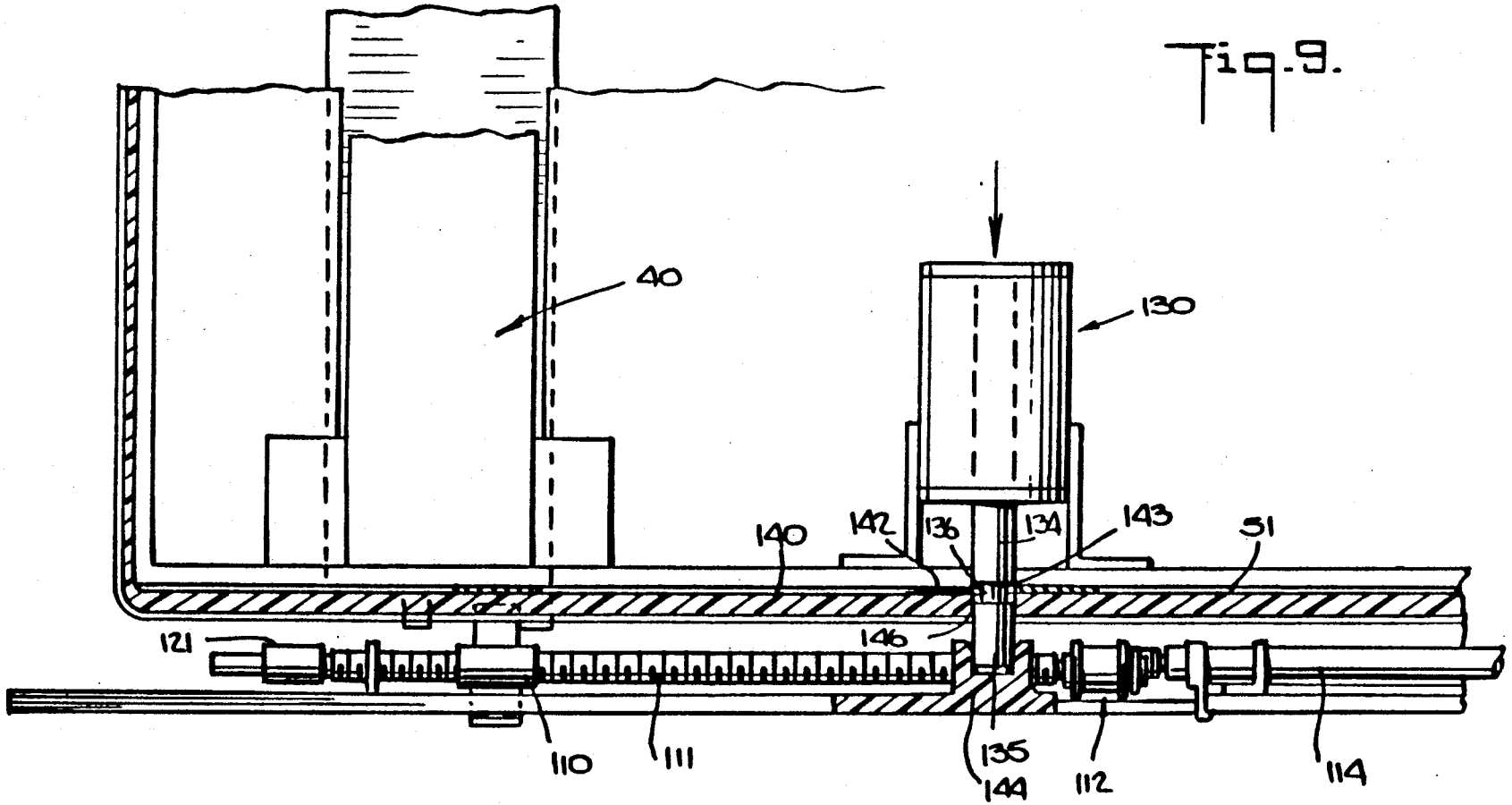
FIG. 9 is a view similar to that of FIG. 8 showing the locking solenoid in its shutter opening position and with the shutter closed and the shutter carrier in the wait position.
Figure 10:
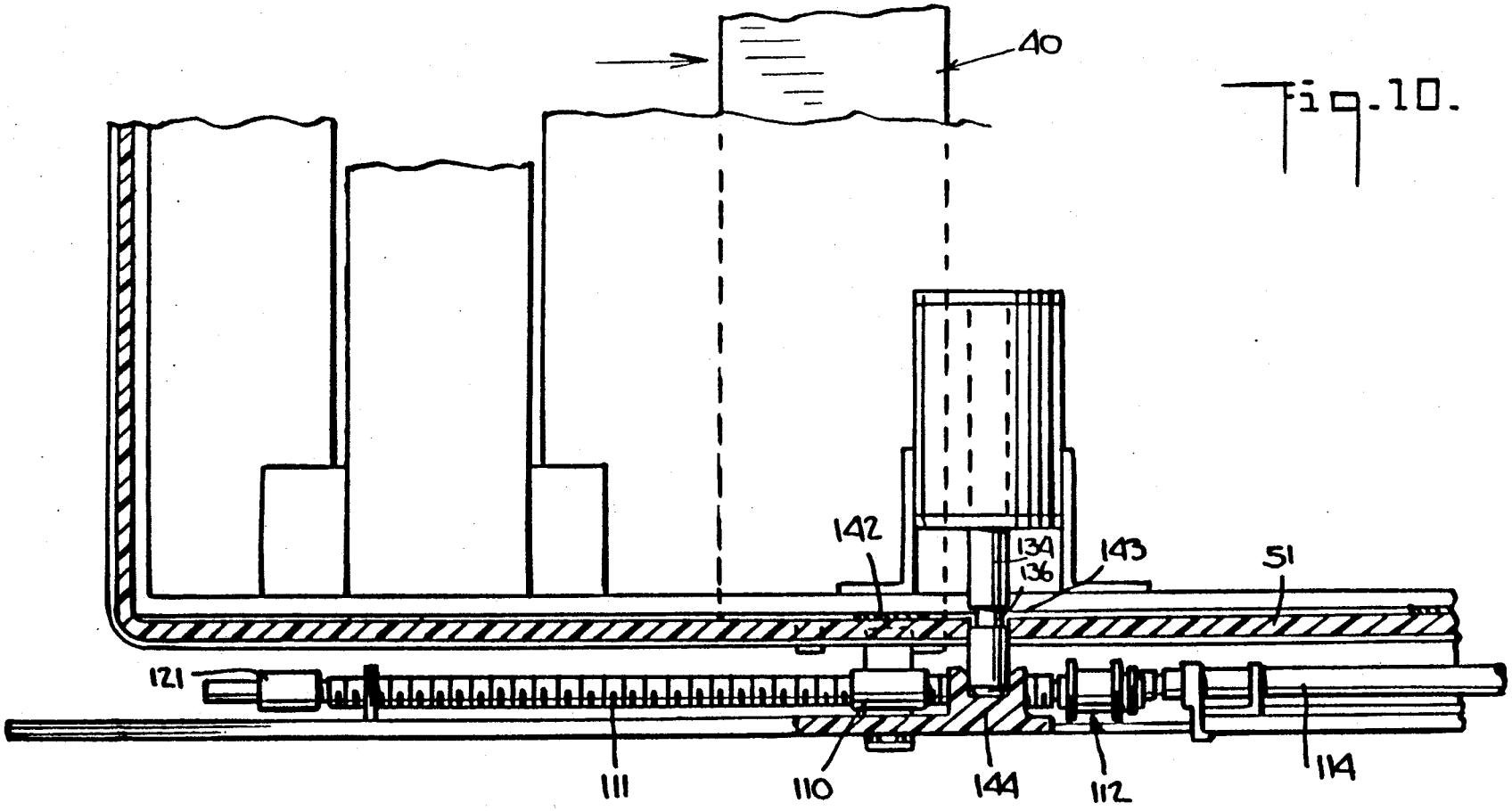
FIG. 10 is a view similar to that of FIG. 9 showing the shutter locking solenoid in its shutter opening position with the shutter open and the shutter carrier in its open position.
Figure 11:
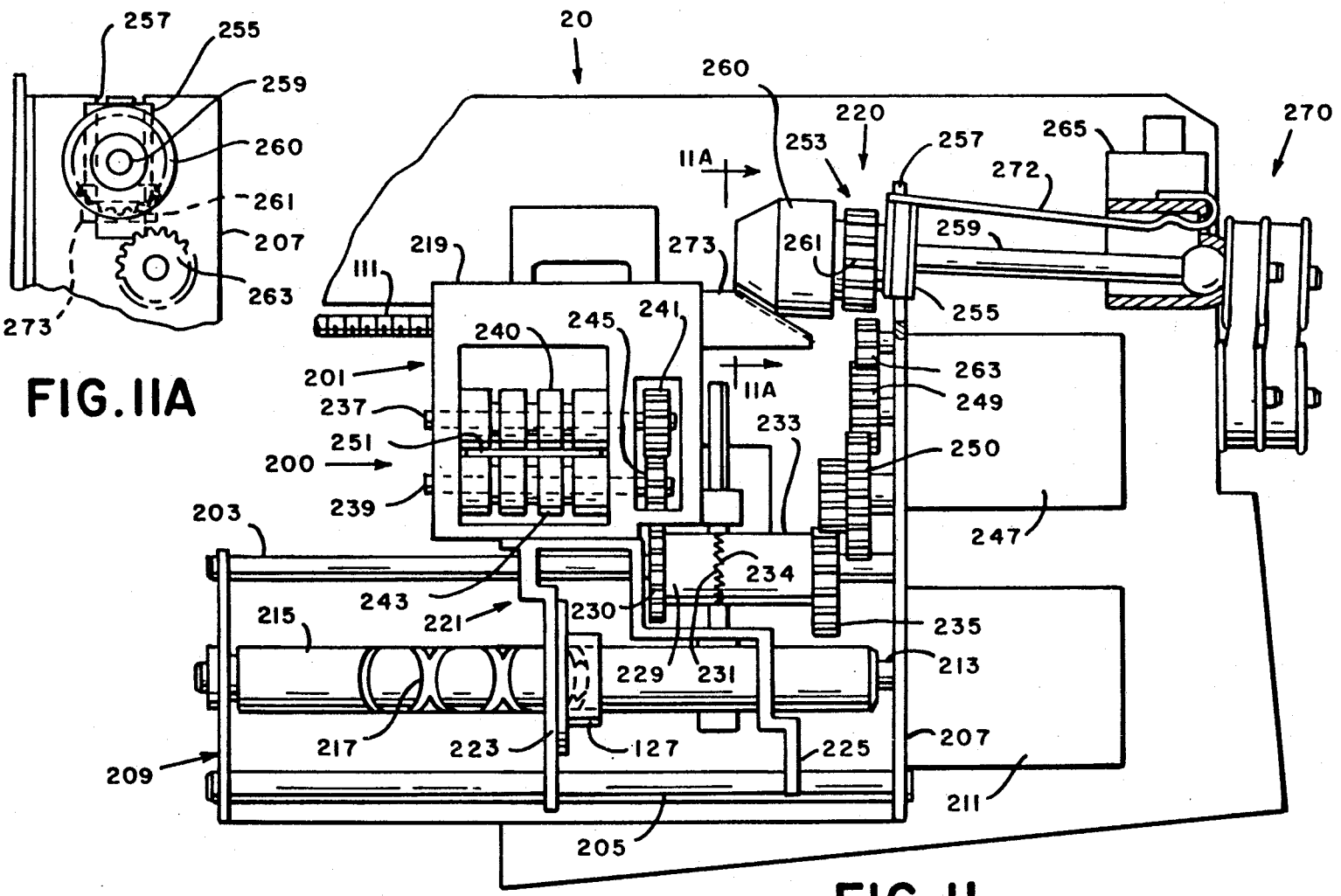
FIG. 11 is a side view partially in section of the portion of the postage meter and locking device which locks the postage meter in a predetermined position, showing the locking device uncoupled.
Figure 12:
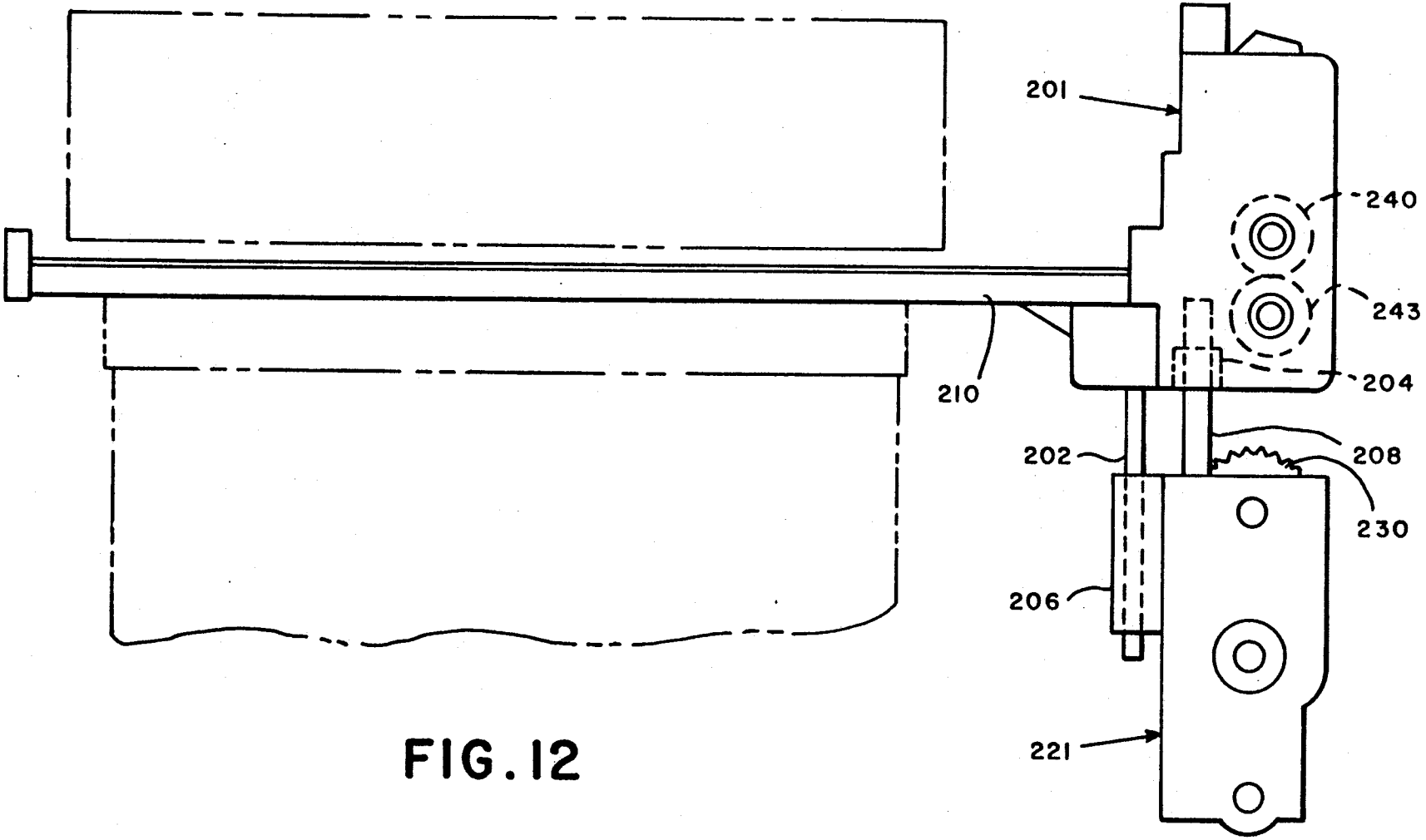

Referring to FIGS. 8–10, solenoid 130 in postage meter 20 locks shutter bar 40 in the closed position as depicted in FIG. 2. Shaft 132 of solenoid 130 includes larger diameter portions 134, 135 and smaller diameter portion 136 which define an angular groove between larger diameter portions 134, 135. Attached to shutter bar 40 within meter 20 is plate 140 (FIG. 5), which extends along the inside of side 51 of meter 20 to slide therealong as shutter bar 40 is moved between its open and closed positions. Plate 140 includes a narrow slot 142 therein which includes a larger circular part 143. When the shaft of solenoid 130 is in its retraced position depicted in FIG. 8, larger diameter shaft portion 135 is aligned within the larger circular part 143 of plate 140. Thus, larger diameter shaft portion 135 engages narrow slot 142 of plate 140 to prevent sliding thereof relative to solenoid 130, and hence locks shutter bar 40 in it closed position illustrated in FIG. 8.

When solenoid 130 is energized, shaft 132 is moved outwardly of solenoid 130 as depicted in FIG. 9 to register the smaller diameter shaft portion 136 with narrow slot 142. This permits the movement of plate 140 and with it shutter bar 40 to the position depicted in FIG. 10. Larger diameter shaft portion 135 is received in a receptacle 144 in locking device 134 to precisely align smaller diameter shaft portion 136 with narrow slot 142. Meter side 51 includes a hole 146 into which larger diameter portion 135 extends to lock plate 140 (FIG. 8), and through which, it projects into receptacle 144 (FIG. 9). Shaft 136 of solenoid 130 is spring loaded so that it returns to the retracted position of FIG. 8 when power to solenoid 130 is interrupted. Thus, when power is applied to solenoid 130, shaft 134 is extended to the unlocked position depicted in FIGS. 9 and 10, and when power is interrupted, shaft 134 is retracted to the locked position depicted in FIG. 8.

The mailing machine includes a tape dispensing assembly 200 comprised of a tape feed carriage assembly 201. The feed carriage 201 is slidably supported on rails 203 and 205 respectively. The rails 203 and 205 are fixably mounted respectively at one end to mailing machine support wall 207 and at their other end to support wall 209. A first drive motor 211 is fixably mounted to the support wall 207 having an output shaft 213 coupled to one end of a cam rod 215. The cam rod 215 includes a form cam track 217. The cam rod 215 is rotatively supported at its other end in support wall 209.

The feed carriage 201 includes a frame 219 mounted to support linkage 221. The frame 219 includes a vertical guide pin 202 and a collar 204. The support linkage also includes a collar 206 which slidably receives pin 202 and a pin 208 which is slidably received in the collar 204 thereby allowing the frame 219 which includes a tape track 210 to be vertically displaced by, for example, the platen of a mailing machine, to bring the tape track 210 into printing position with the postage meter. The support linkage 221 also includes vertical support links 223 and 225. The rail 203 extends through aligned apertures in the respective support links 223 and 225 such that the support linkage 225 can be slidably displaced along rail 203 in a manner subsequently described. The cam rod 215 also extends through respectively aligned apertures in support links 223 and 225. A C-sided opening is formed in the lower end of the respective support links 223 and 225 to extend partially around the support rod 205. The support link 223 has fixably mounted thereto a cam collar 127 around the cam rod 215 such that upon rotation of the cam rod 215 by motor 211, the follow (not shown) of the cam collar 127 tracks in the cam track 217 to cause the carriage assembly to reciprocally displace laterally along rails 203 and 205 between a home and second position.

In the second position, the tape track 210 is aligned such that a platen may be activated to bring the track 210 into contact with the postage meter for imprint on any tape carried in the track 210. Assembly 201 is permitted to vertically displace during this printing operation along rods 202 and 208.

Rotatively mounted to the support link 225 around rail 203 by any conventional means is a gear hub 229 having radial gear 230 and axial gear 231. The rail 203 has rotatively mounted therearound by any conventional means a gear hub 233 having radial gear 234 and axial gear 235. The gear hubs 230 and 233 are along the rail 203 such that when the carriage assembly 200 is in the home position, gears 231 and 234 are brought into engaging contact.

The feed carriage frame 219 rotatively supports first and second shafts 237 and 239, respectively. Fixably mounted around respective portions shaft 237 is a roller 240 and a gear 241. In like manner, a roller 243 and gear 245 are fixably mounted around shaft 239 such that the rollers 240 and 243 are radially aligned and gears 241 and 245 are in radial engagement.

A second motor 247 having a drive gear 249 is fixably mounted to the support wall 207. A gear set 250 is rotatively mounted to the support wall 207 and provides intermediate communication between gear 249 and 235. It is now apparent that positioning of the carriage assembly 200 in the home position by motor 211 brings gears 231 and 234 into engaging contact. Actuation of motor 247 can then cause tape 251 to be advanced in a tape track (not shown) supported by the frame 219 by rollers 240 and 243.

The drive assembly 220 further includes a gear assembly 253 which includes a slide plate 255 slidably captured in a slot 257 formed in support wall 207. Rotatively mounted in the slide plate 255 is a shaft 259. At one end of shaft 259 is rotatively mounted a striker hub 260 followed by a fixably mounted gear 261. A gear 263 in constant mesh with gear 249 is rotatively mounted to support wall 207 and aligned for engagement with gear 261. A bracket 265 is fixably mounted to wall 172 which pivotally and rotatively supports the shaft 259. Fixably mounted to the other end of the shaft 259 are belt couplers 270 in respective belt communication with couplers 117 for driving the drive mechanism 45 as described. A leaf spring 272 is affixed to the bracket 265 and extends to contact the slide plate 255 for urging the slide pate 255 downwardly in the slot 257. The carriage assembly frame 219 has fixably mounted thereto a striker 273 aligned to the striker hub 260 such that when the carriage assembly 200 is in the home position, the striker 273 is brought into forced engagement with the striker hub 260 resulting in disengagement of gear 253 from gear 263. In this case, the motor 247 is employed to drive the tape feed assembly 201. When the tape feed assembly 201 is in the second position, the spring 272 forces gears 261 into engagement with gear 263. The motor 247 can then be used to drive the mechanism 45.

Certain changes in modifications of the embodiments of the invention herein disclosed will be readily apparent to those skilled in the art. Moreover, uses of the invention other than in postage meters and mailing machines will also be readily apparent to those with skill in the art. It is the applicants' intention to cover by the claims all such uses and all such changes and modifications which could be made to the embodiments of the inventions herein chosen for the purpose of disclosure which do not depart from the spirit and scope of the invention.

What is claimed is:

1. An improved combination of a mailing machine base and a postage meter insertable into a receptacle in said mailing machine having meter engagement means for operatively engaging a shutter bar of said postage meter, said mailing machine having a tape feed assembly having a frame positionable by a first drive means between a home position and a print position, and a second drive means for causing tape to be fed through said frame of said tape feed assembly, wherein the improvement comprises:

coupler means for causing said second drive means to be coupled to said tape feed assembly only when said tape feed assembly is in the home position and for causing said second drive means to be coupled to said engaging means only when said tape feed assembly is in said print position; and said first drive means comprises a cam rod rotatively supported in said base and having a cam track formed partly along the length of said cam rod, a first drive motor coupled to said cam rod, a cam follower means fixably mounted to said frame of said tape feed assembly, said frame having a cam follower confined to said cam track for causing displacement of said frame upon actuation of said first drive motor.

2. An improved combination as claimed in claim 1 further comprising means for allowing said frame of said tape feed assembly to be vertically displaceable.

3. An improved combination as claimed in claim 2 wherein said coupler means comprises:

said frame having a first frame section including a tape track, feed means for receiving a tape and causing said tape to displace in said tape track, and gear means for driving said feed means, said tape track being fixably mounted to said first frame section at one end and aligned to receive tape from said feed means;

rail means fixably mounted in said base for displaceable supporting tape frame therealong;

said frame having a second frame section for support, said first frame section can vertically displace relative to said first frame section and for riding laterally along said rail means;

said gear means having a first gear hub rotatively mounted to said frame; and, a second gear hub rotatively mounted in said base and coupled to said second drive means, said first and second gear hubs being aligned such that they are brought into engaging contact only when said tape frame assembly is in the home position.

* * * * *